US008480248B2

(12) United States Patent
Demarest et al.

(10) Patent No.: US 8,480,248 B2
(45) Date of Patent: Jul. 9, 2013

(54) CIRCUIT FOR COLOR CHANGING LED DEVICES WITH VOLATILE ACTIVE EMISSIONS

(75) Inventors: Scott W. Demarest, Caledonia, WI (US); Simon M. Conway, Burlington, WI (US); Kevin Harrity, Oak Creek, WI (US); Scott D. Walter, Twin Lakes, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 361 days.

(21) Appl. No.: 12/734,275

(22) PCT Filed: Oct. 29, 2008

(86) PCT No.: PCT/US2008/081582

§ 371 (c)(1),
(2), (4) Date: Jun. 30, 2010

(87) PCT Pub. No.: WO2009/058862

PCT Pub. Date: May 7, 2009

(65) Prior Publication Data

US 2010/0283407 A1 Nov. 11, 2010

Related U.S. Application Data

(60) Provisional application No. 60/983,379, filed on Oct. 29, 2007.

(51) Int. Cl.
*F21V 33/00* (2006.01)

(52) U.S. Cl.
USPC ..... 362/96; 362/101

(58) Field of Classification Search
USPC .. 362/96, 101, 234, 249.05, 641, 643; 239/44
See application file for complete search history.

(56) References Cited

U.S. PATENT DOCUMENTS

| | | | | |
|---|---|---|---|---|
| 4,998,055 | A | 3/1991 | Nash et al. | |
| 5,015,546 | A | 5/1991 | Dulaney et al. | |
| 5,099,514 | A | 3/1992 | Acree | |
| 5,686,808 | A | 11/1997 | Lutz | |
| 6,321,340 | B1 | 11/2001 | Shin et al. | |
| 6,430,858 | B1 | 8/2002 | Andre | |
| 6,476,595 | B1 | 11/2002 | Heuell et al. | |
| 6,866,527 | B2 | 3/2005 | Potega | |
| 6,940,711 | B2 | 9/2005 | Heuell et al. | |
| 6,943,527 | B2 | 9/2005 | Liu et al. | |
| 6,982,390 | B2 | 1/2006 | Heuell et al. | |
| 2004/0264169 | A1 * | 12/2004 | Limburg et al. | 362/96 |
| 2005/0185392 | A1 * | 8/2005 | Walter et al. | 362/96 |
| 2005/0285538 | A1 * | 12/2005 | Jaworski et al. | 362/96 |
| 2006/0061332 | A1 | 3/2006 | Neu et al. | |
| 2006/0171149 | A1 * | 8/2006 | Yuen | 362/234 |
| 2006/0221594 | A1 * | 10/2006 | Rann et al. | 362/96 |
| 2007/0086154 | A1 | 4/2007 | Koch | |
| 2007/0182363 | A1 | 8/2007 | Yang | |

* cited by examiner

*Primary Examiner* — Y My Quach Lee

(57) ABSTRACT

A control circuit for color changing LED devices with volatile active emissions and hidden input jacks is disclosed. The circuit allows the device to use variously sized power adapters, and a plurality of colored LEDs positioned so as to emit a colored light show. The circuit also includes a volatile active dispenser to control volatile active emission rates. A hidden input jack is also disposed to provide additional power as required. Thus, the circuit provides the combination of illumination and/or ambient light, colored light shows, volatile active emission control, and combinations thereof, within a single standalone device.

21 Claims, 14 Drawing Sheets

CIRCUIT FOR COLOR CHANGING LED DEVICES WITH VOLATILE ACTIVE EMISSIONS

CROSS REFERENCE TO RELATED APPLICATION

This application is an international application which is based on and claims priority under PCT Rule 4.10(a) from provisional Application Ser. No. 60/983,379, filed on Oct. 29, 2007 in the United States of America.

FIELD OF THE DISCLOSURE

The present disclosure relates to a circuit for lighting devices and, more particularly to a modular circuit for color changing LED devices with volatile active emissions and hidden input jacks.

BACKGROUND OF THE DISCLOSURE

Creating a pleasant ambiance is a popular aspect of home decor. This is often achieved through various combinations of pleasant fragrances with mood lighting. Lighting can also be combined with other functions such as air sanitization, air deodorization, and the controlled release of insect repellent, insect attractant and insecticide. Conventional products such as scented candles, mood lighting devices, fragrance dispensers, and the like, are commonly used to create a pleasant environment in the home. While those conventional products help to create a pleasant living environment and ambiance, they have their drawbacks.

For example, while scented candles create soft light and fragrance, which creates a pleasant mood, candles are a potential fire hazard and often produce unwanted smoke and wax drippings. Traditional light fixtures and lamps do not provide the color effects, fragrance emission or other volatile active emissions that users often desire. While stand-alone aesthetic devices are available for providing lighting effects (such as color changing and the like), these stand-alone devices do not provide volatile active emissions and take up additional space around the home, adding to the clutter that many consumers are trying to avoid. Additionally, light fixtures and stand-alone devices have external switches, power cords, and the like, which make the devices themselves unattractive.

Furthermore, traditional light fixtures, lamps and stand-alone devices require a DC power supply, an AC power supply, or a combination of both. More specifically, a device requiring a DC power supply uses batteries and a device requiring an AC power supply uses a power cord. A device that uses batteries eliminates the need for unsightly power cords and does not take up additional outlets. However, batteries provide limited power and need to be replaced periodically, resulting in additional costs to the consumer. Alternatively, a device that uses a power cord minimizes additional expenses to the consumer. However, the power cord adds clutter to the home and takes up additional outlets.

A device that provides a combination of both DC and AC power supplies, or a dual power supply, gives the consumer the option of selecting between the two sources. In general, such devices include a compartment for batteries and an input jack for an adapter plug. When using the DC power supply, batteries are supplied to the device and the input jack is left unplugged. When using the AC power supply, the batteries are removed and an adapter is connected between the input jack and a wall outlet. While dual power supplies offer the benefits of both power options to the consumer, such devices are generally sold without the adapter. In order to take full advantage of the dual power supply without the added costs, the consumer is forced to locate an unused adapter around the house. However, it is usually more difficult to find an adapter matching the exact size and voltage rating as required by the input jack.

Conventional fragrance dispensers, such as plug-in diffusers, can provide pleasing aromas in a relatively inexpensive, compact package. However, such conventional fragrance dispensers generally take up outlets and are often located out of sight, causing a user to forget to adjust or refill the device. While these fragrance dispensers may also provide light, because the devices are used in existing electrical outlets, they are generally positioned too low to provide effective lighting features, other than to operate as a nightlight.

Conventional nightlights include only white light emission in combination with fragrance emission. While a single scent may be provided in the form of a decorative diffuser, colored nightlights are not generally available and there is no coordination between the light color emitted and the particular fragrance emitted. Moreover, sophisticated multi-colored lights that change color and that are aesthetically pleasing in combination with fragrance emission are not currently available.

Further, numerous needs exist for devices providing the combination of white light and/or colored light with volatile active emissions other than fragrances, such as air sanitization, air deodorization, the controlled release of insect repellent, insect attractant, insecticide, aromatherapy volatiles or other non-fragrant materials (any of which may be combined with fragrant materials if necessary to make the ambient environment more tolerable). More importantly, numerous needs exist for compact modular circuits enabling the combinations of colored light and volatile active emissions. Modular circuits allow for the interchangeability of parts and features while also promoting expandability.

Recent developments in lighting have led to advancement in light emitting diodes (LEDs) and supporting drive circuits. An LED is a semiconductor device that emits visible light when an electrical current passes through it. The light from an LED is basically monochromatic and the color of the light is determined by the particular material used in the semiconductor (although current applied to the LED can be used to vary the perceived color). LEDs have the advantage of low power requirements, high efficiency and long life. The outputs of several different colored LEDs can be mixed so as to produce additional colors, including white light, and different intensities. LEDs can also be used to provide background lighting to achieve desired ambient effects. Until now, LEDs and supporting circuitry have been generally used for such applications as indicator lights, panel backlighting and fiber optic data transmission.

LED lamps having multicolor adjustors with supporting circuitry or the like exist. These devices typically comprise a base in which several LEDs capable of producing different colored light are mounted upon a circuit board. The circuit provides adjustable and external switches for the different color LEDs so that the colors can be mixed in any desired ratio to produce desired lighting effects such as varying colors and intensity.

Devices also exist having circuits for providing ambient light from a free-standing lamp using LEDs. In one such device, ambient light in the form of a simulated candle is provided by a microprocessor and supporting circuitry emitting both color combinations and flicker effects. These devices are directed toward lamps with external switches for achieving soothing ambient effects. There are also other devices with circuits for controlling the light output of several LEDs according to user input and the predetermined program installed. The user input is provided by external switches disposed on a housing. However, there is no device or circuit having aesthetically pleasing and discrete switches that allow user control of volatile active emissions and ambient light with multiple colored LEDs within a single fixture.

Therefore, multiple needs exist for controllers and related circuitry that provide for discrete switches and the combination of one or more of the following functions: white light emission; colored light emission; colored light shows; fragrance emission; air sanitization; air deodorization; insecticide emission; insect repellent emission; aromatherapy material emission; light emission that repels insects; light emission that attracts insects; and any combinations thereof. Furthermore, needs exist for the modular design of the circuitry. Additional needs exist for controllers and related circuitry that provide dual power supplies having an input jack capable of receiving a wide range of adapters, in terms of both plug sizes and voltage ratings.

SUMMARY OF THE DISCLOSURE

In accordance with one aspect of the disclosure, a modular circuit for lighting devices with volatile active emissions is provided which comprises a control unit; a power jack module; and a battery compartment. The control unit comprises a driver circuit, a microprocessor, a plurality of light emitting diodes (LEDs), and an active dispenser.

In accordance with another aspect of the disclosure, a modular circuit for lighting devices with volatile active emissions is provided which comprises a power jack module; a battery compartment; a hidden input jack disposed within the battery compartment; and a control unit. The control unit comprises a driver circuit, a microprocessor, a plurality of colored LEDs, and a volatile active dispenser. The volatile active dispenser comprises one or more components selected from the group consisting of a low CFM fan; a high CFM fan; a heater element; and a piezo electric atomizer.

In accordance with another aspect of the disclosure, a modular circuit for lighting devices with volatile active emissions is provided which comprises a control unit; a power jack module; a battery compartment; a hidden input jack disposed within the battery compartment; and at least one switch performing one or more functions selected from the group consisting of activating a colored light show; turning off the colored light show; holding a color selected from the colored light show; adjusting an intensity of the colored LEDs; adjusting an output rate of the volatile active dispenser; and scrolling through the plurality of colored light shows. The control unit comprises a driver circuit, a microprocessor storing a plurality of colored light shows, a plurality of colored LEDs, and a volatile active dispenser.

These and other aspects of this disclosure will become more readily apparent upon reading the following detailed description when taken in conjunction with the accompanying drawings.

Figure 1A:
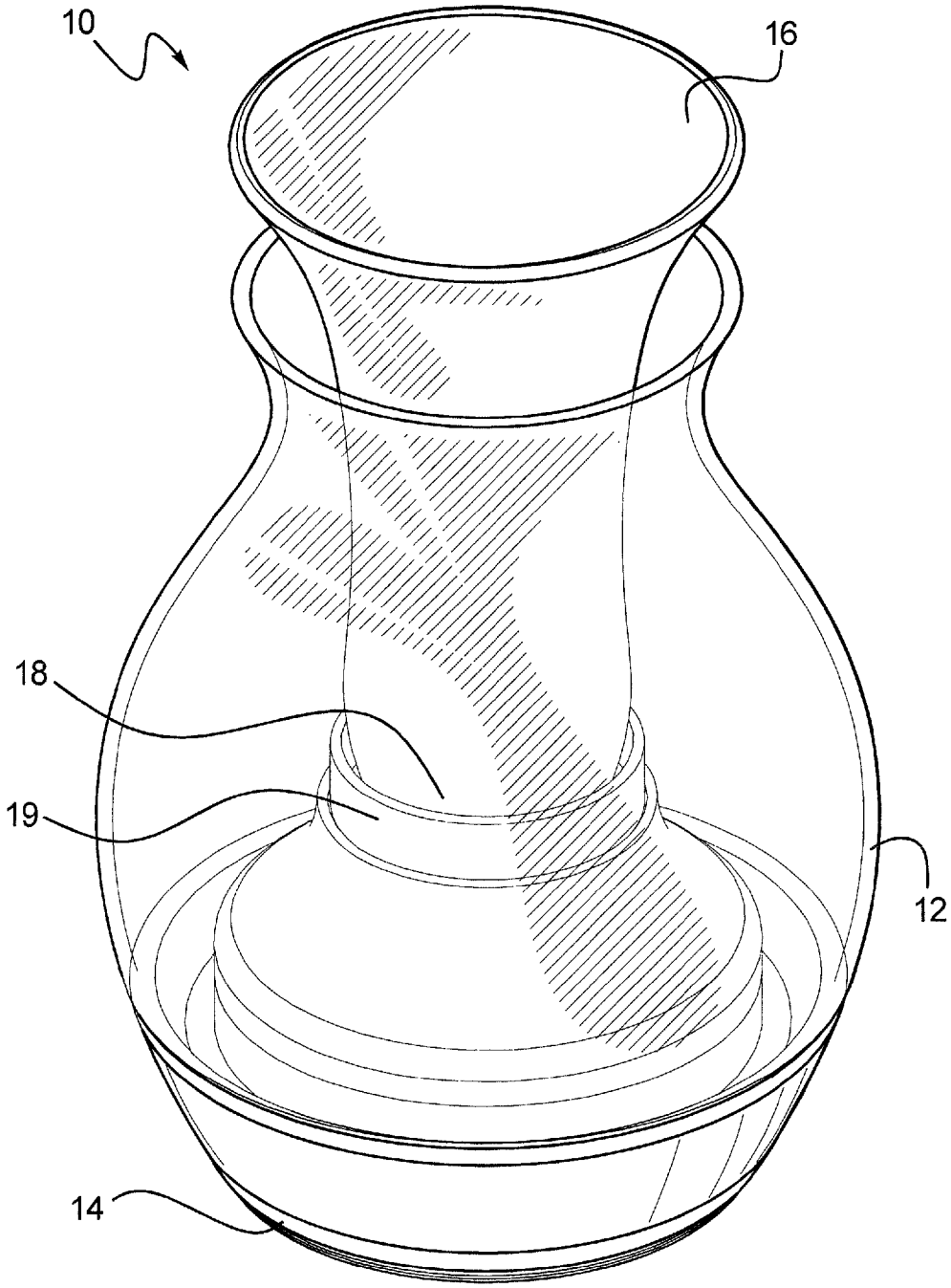
FIGS. 1A-1B are perspective views of an exemplary color changing LED device with volatile active emissions.

While the present disclosure is susceptible to various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions, and equivalents falling with the spirit and scope of the present invention.

DETAILED DESCRIPTION OF THE DISCLOSURE

Figure 4:
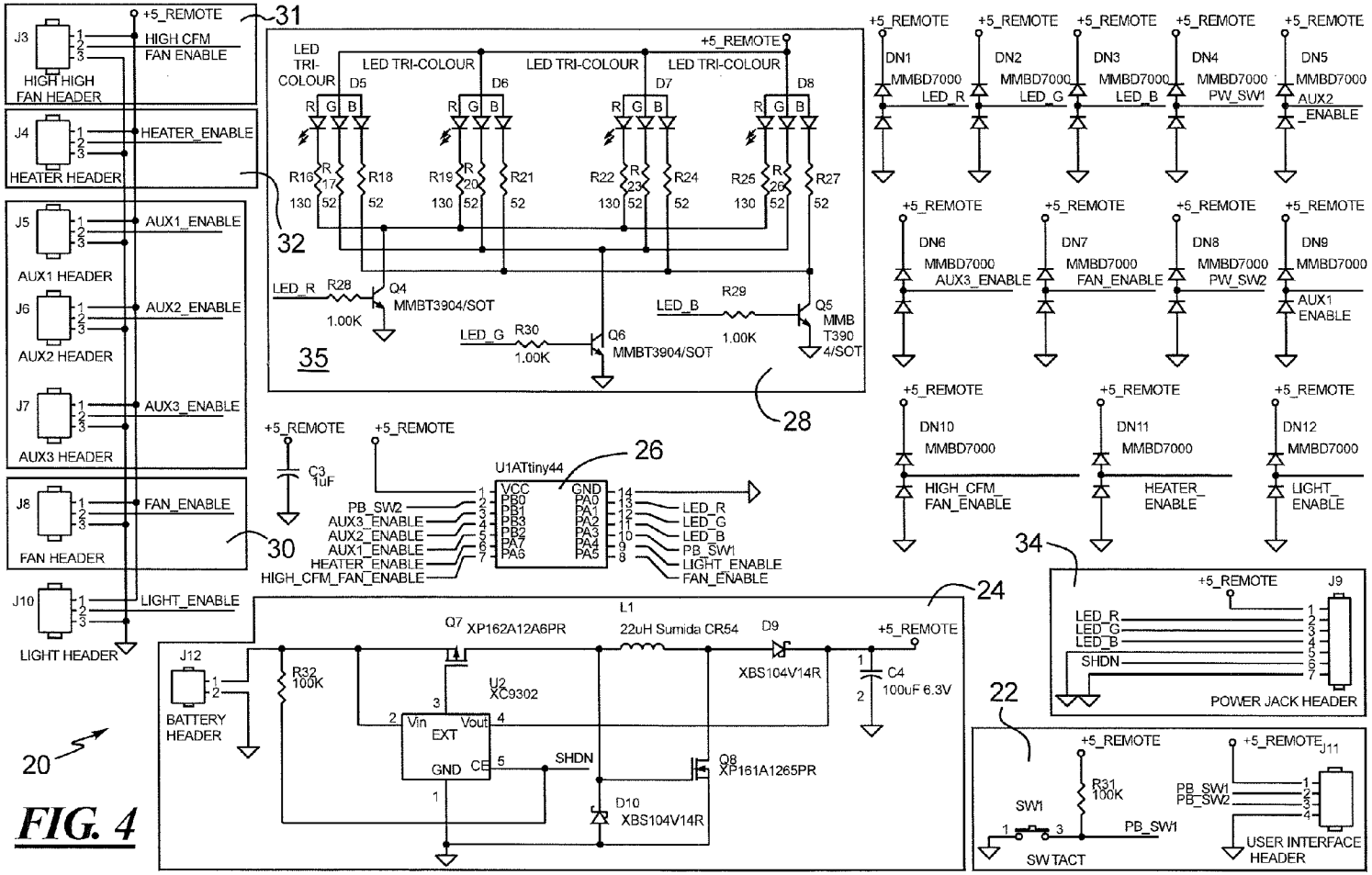
FIG. 4 is an exemplary control unit constructed in accordance with the teachings of the disclosure.
Figure 5:
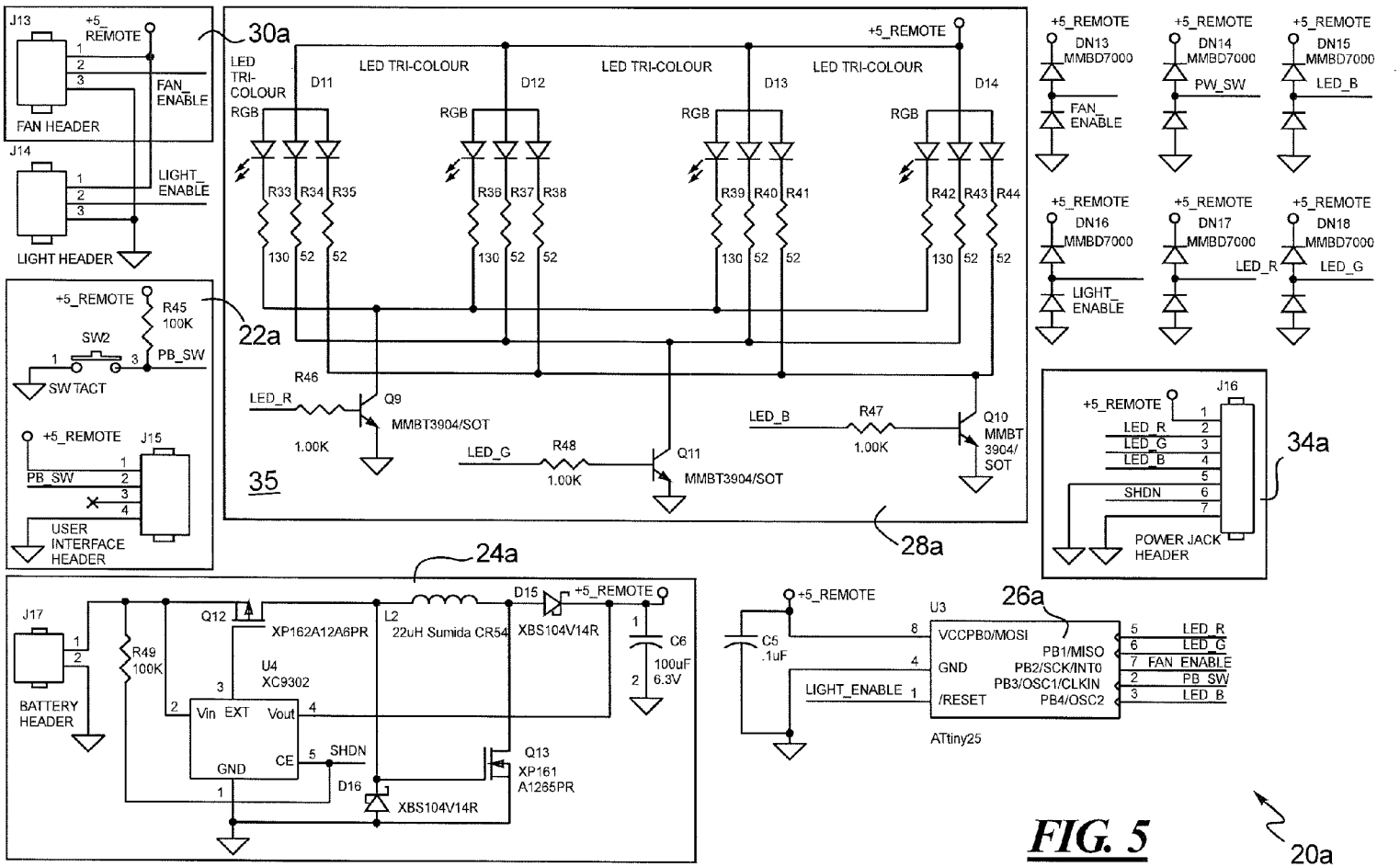
FIG. 5 is another exemplary control unit constructed in accordance with the teachings of the disclosure.

Referring now to the drawings and with particular reference to FIGS. 1-3, exemplary color changing LED devices having volatile active emissions are generally referred to as reference numeral 10. With further reference to FIGS. 4 and 5, exemplary control units for emitting light and volatile actives are generally referred to as reference numeral 20. It is understood that the teachings of the disclosure can be used to construct control units and related circuitry above and beyond that specifically disclosed below. One of ordinary skill in the art will readily understand that the following are exemplary embodiments.

Figure 1B:
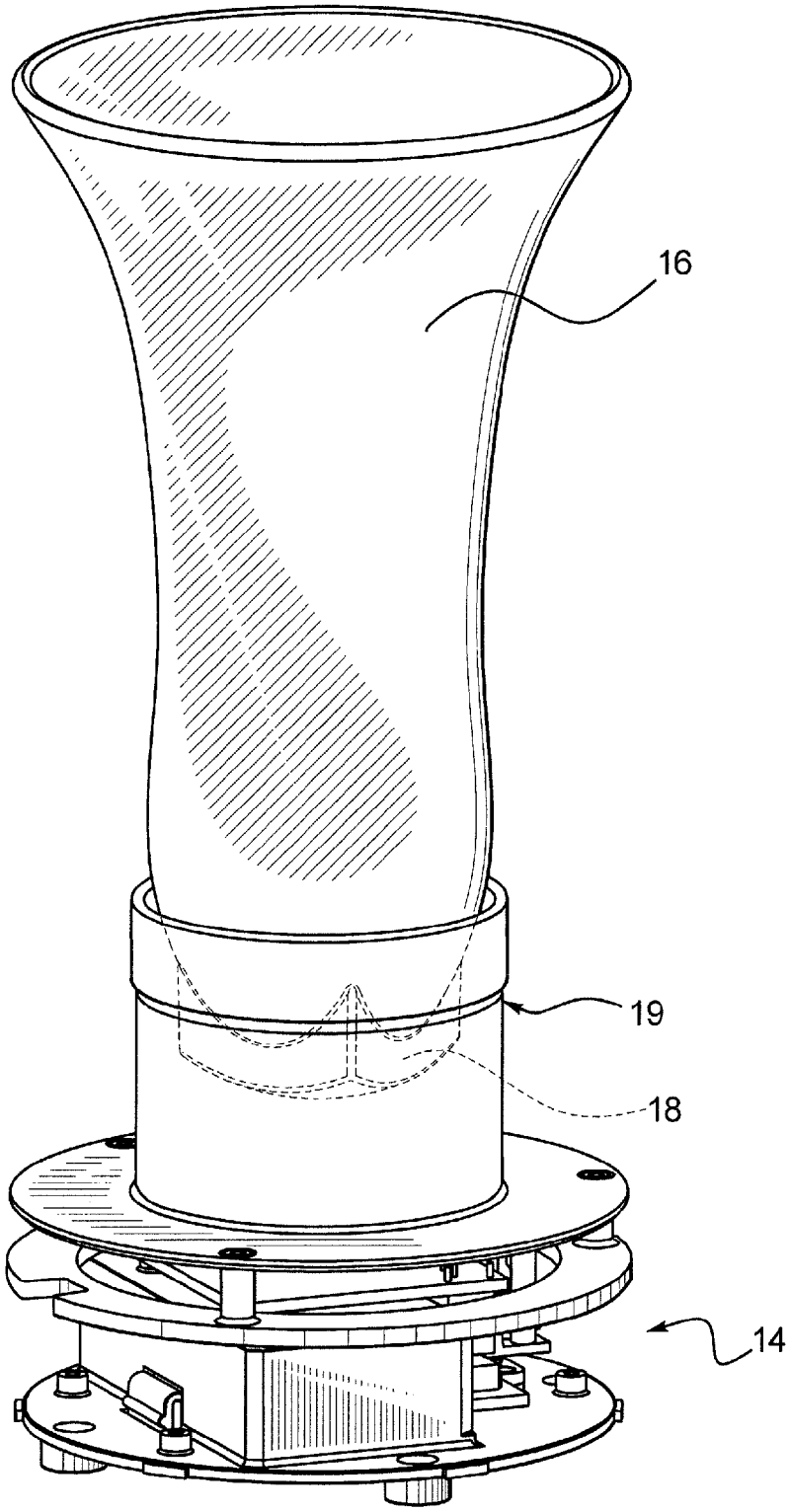

One example of a device that may use the circuitry and electronics described herein is shown in FIGS. 1A and 1B. The color changing light source and volatile active dispenser or device 10 may provide a translucent globe 12 coupled to a base 14. The translucent globe 12 may serve to at least partially diffuse, transmit and/or reflect light, while the base 14 may provide circuitry and electronics for driving the device 10 in response to user input. A volatile active cartridge 16 may be partially disposed within the translucent globe 12 for emitting a volatile active. The device 10 may provide a more aesthetically pleasing design by eliminating external switches and by using the active cartridge 16 as the user interface, as discussed more specifically below.

As shown in more detail in FIG. 1B, the volatile active cartridge 16 may be removably coupled to the base 14 via a key 18 and a corresponding switch 19. More specifically, the key 18 may be any shape or form disposed on the cartridge 16 and mateably received by the switch 19, such that rotating the cartridge 16 also rotates the key 18 and the associated switch 19. Rotating and/or changing the relative position of the switch 19 with respect to the base 14 may cause the device 10 to perform different tasks. Alternatively, pushing the cartridge 16 toward the base 14, and thus pressing the switch 19, may also initiate a task. The device 10 may also include more than one type of switch 19 such that the device 10 responds to a cartridge 16 and key 18 that may be turned, rotated, pressed, pulled, tilted, touched, or any combinations thereof.

Figure 2A:
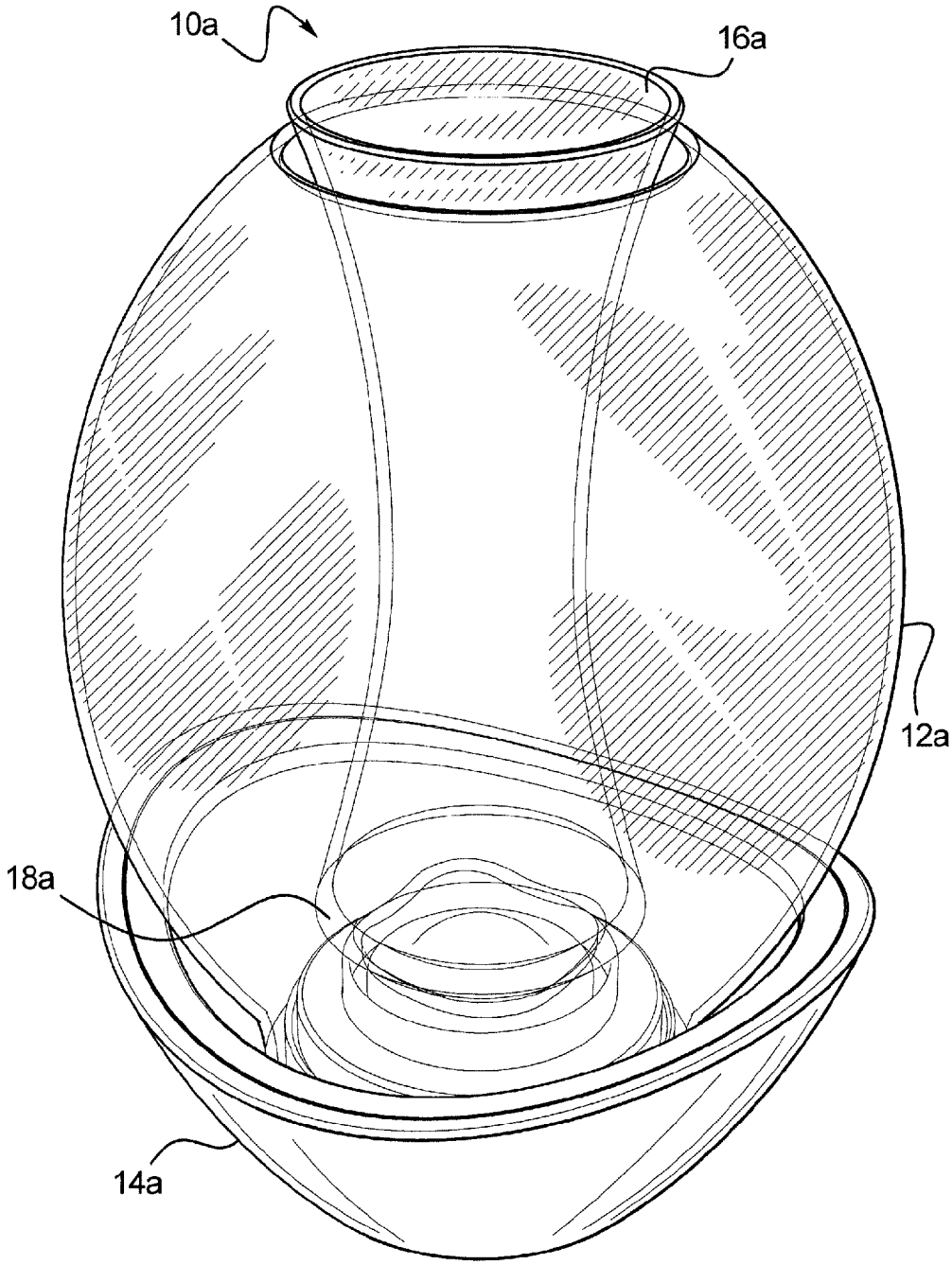
FIGS. 2A-2B are perspective views of another exemplary color changing LED device with volatile active emissions.
Figure 2B:
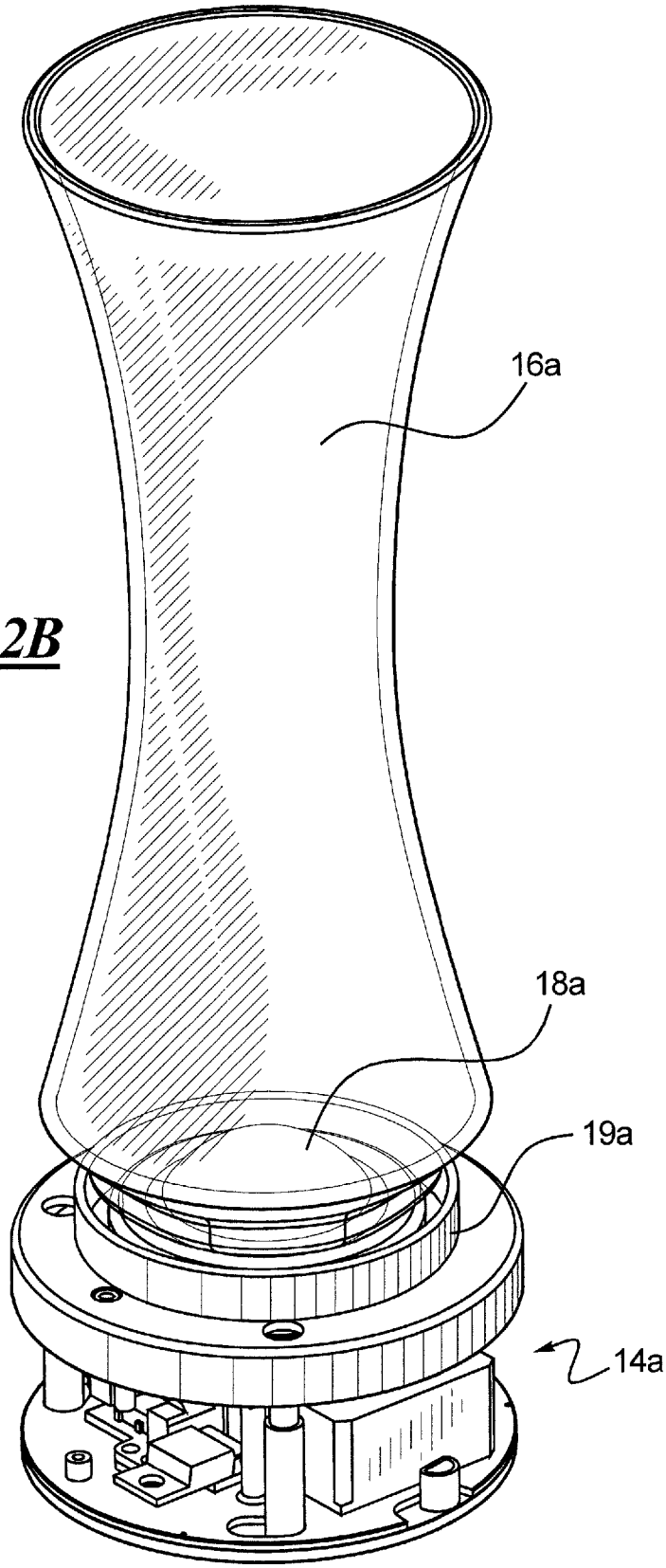

A second example of a device that may also use the circuitry and electronics, as described herein, is shown in FIGS. 2A and 2B. The color changing light source and volatile active dispenser or device 10*a* may provide a translucent globe 12*a* coupled to a base 14*a*. As with the device 10 of FIGS. 1A and 1B, the translucent globe 12*a* may serve to partially diffuse light, while the base 14*a* provides various circuitry and electronics for driving the device 10*a* in response to user input. Furthermore, a replaceable cartridge 16*a* is partially disposed within the translucent globe 12*a* for emitting a volatile active and for providing an aesthetically pleasing user interface.

In the more detailed drawing of FIG. 2B, the volatile active cartridge 16*a* is removably coupled to the base 14*a* via a key 18*a* and a corresponding switch 19*a*. More specifically, the key 18*a* may be any shape or form that is disposed on the cartridge 16*a* and mateably received by the switch 19*a*, such that rotating the cartridge 16*a* also rotates the switch 19*a*. In a similar manner to the device 10 of FIG. 1B, rotating and/or changing the relative position of the switch 19*a* with respect to the base 14*a* may cause the device 10*a* to perform different tasks. Alternatively, pushing the cartridge 16*a* toward the base 14*a*, and thus pressing the switch 19*a*, may also initiate a task. The device 10*a* may also include more than one type of switch 19*a* such that the device 10*a* responds to a cartridge 16*a* and key 18*a* that may be turned, rotated, pressed, pulled, tilted, touched, or any combination thereof.

Figure 3A:
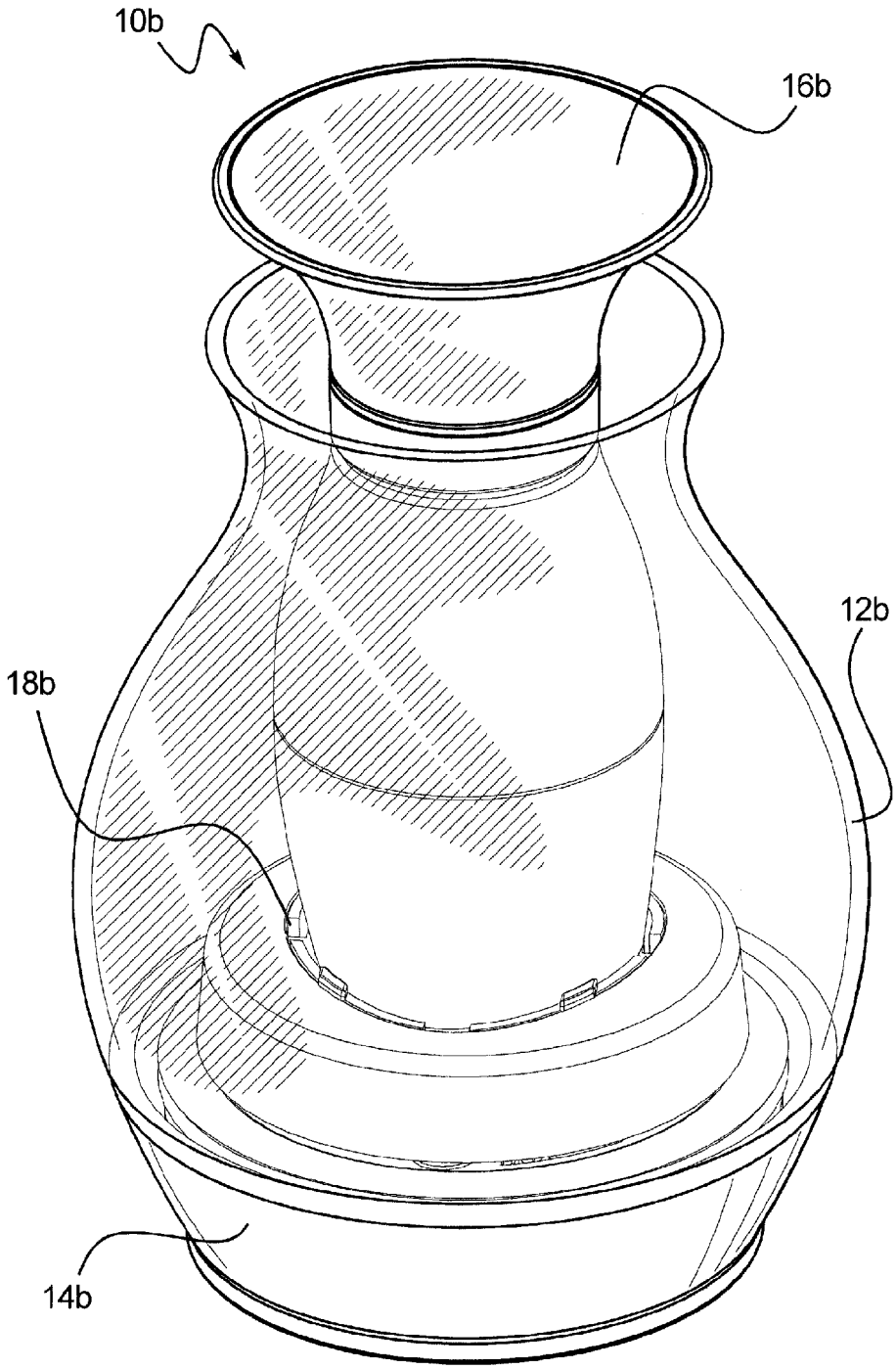
FIGS. 3A-3B are perspective views of another exemplary color changing LED device with volatile active emissions.
Figure 3B:
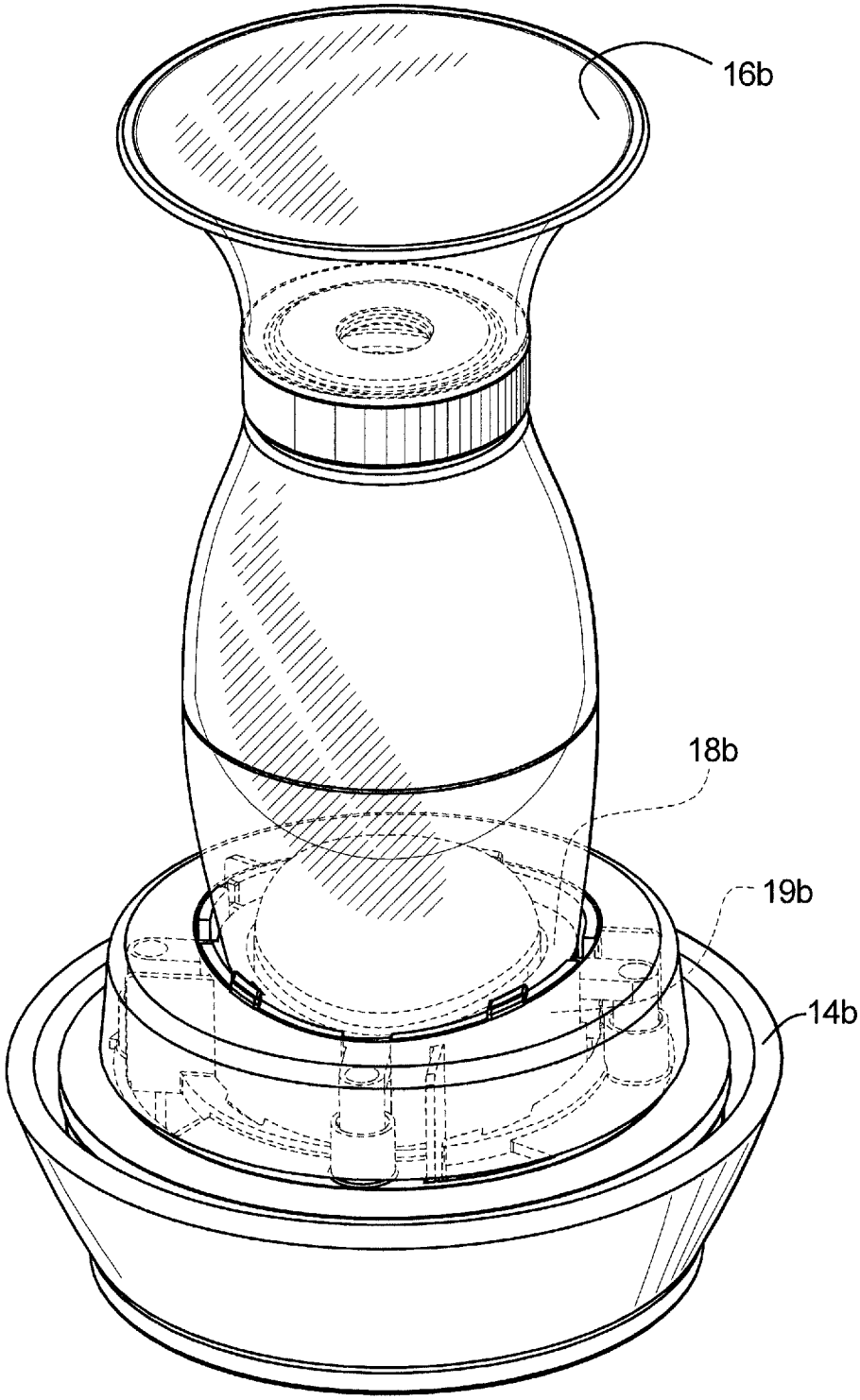

Yet another device that may use the circuitry and electronics, as described herein, is shown in FIGS. 3A and 3B. The color changing light source and volatile active dispenser or device 10*b* may provide a translucent globe 12*b* coupled to a base 14*b*. As with the embodiments of FIGS. 1-2, the translucent globe 12*b* may serve to partially diffuse light, while the base 14*b* provides various circuitry and electronics for driving the device 10*b* in response to user input. A replaceable cartridge 16*b* is partially disposed within the translucent globe 12*b* for emitting a volatile active and for providing an aesthetically pleasing user interface.

As in the previous embodiments, the volatile active cartridge 16*b* may be removably coupled to the base 14*b* via a key 18*b* and a corresponding switch 19*b*. More specifically, the key 18*b* may be any shape or form that is disposed on the cartridge 16*b* and mateably received by the switch 19*b*, such that rotating the cartridge 16*b* also rotates the switch 19*b*. In a similar manner to the embodiments of FIGS. 1-2, rotating and/or changing the relative position of the switch 19*b* with respect to the base 14*b* may cause the device 10*b* to perform different tasks. Alternatively, pushing the cartridge 16*b* toward the base 14*b*, and thus pressing the switch 19*b*, may also initiate a task. The device 10*b* may also include more than one type of switch 19*b* such that the device 10*b* responds to a cartridge 16*b* and key 18*b* that may be turned, rotated, pressed, pulled, tilted, touched, or any combination thereof.

Referring now to the schematic of FIG. 4, an exemplary control unit 20 is provided having various subcomponents or modules. The modularity of the control unit 20 provides a flexible design that may be expandable or adaptable to a number of product configurations. More specifically, the individual modules representing different features may be interchanged or taken away from the control unit 20 depending on the desired application or product. The control unit 20 may also be configured to accept auxiliary modules, which while attached may override any redundant components within the control unit 20. In particular, the control unit 20 may include modules for a user interface 22, a driver circuit 24, a microprocessor 26, a light emitting diode (LED) array 28, volatile active dispensers 30, 31, 32, auxiliary connections 33 and a power jack 34. Alternatively, smaller but upgradable controllers may be constructed for more simple applications. For example, the control unit 20*a* of FIG. 5 provides a user interface 22*a*, driver circuit 24*a*, an LED array 28*a* and a power jack 34*a* similar to those of FIG. 4, but offers a smaller microprocessor 26*a* and a fewer number of features. More specifically, the control unit 20*a* of FIG. 5 may provide only one volatile active dispenser for dispensing volatile actives, such as a low output fan 30*a*, while the control unit 20 of FIG. 4 provides a low output fan 30, a high output fan 31 and a heater 32. Furthermore, the control unit 20*a* of FIG. 5 may omit the auxiliary connections 33 found in the control unit 20 of FIG. 4. The plurality of LEDs on the LED array 28 and 28*a* of FIGS. 4 and 5, respectively, may each be disposed on a satellite LED board 35.

Figure 6:
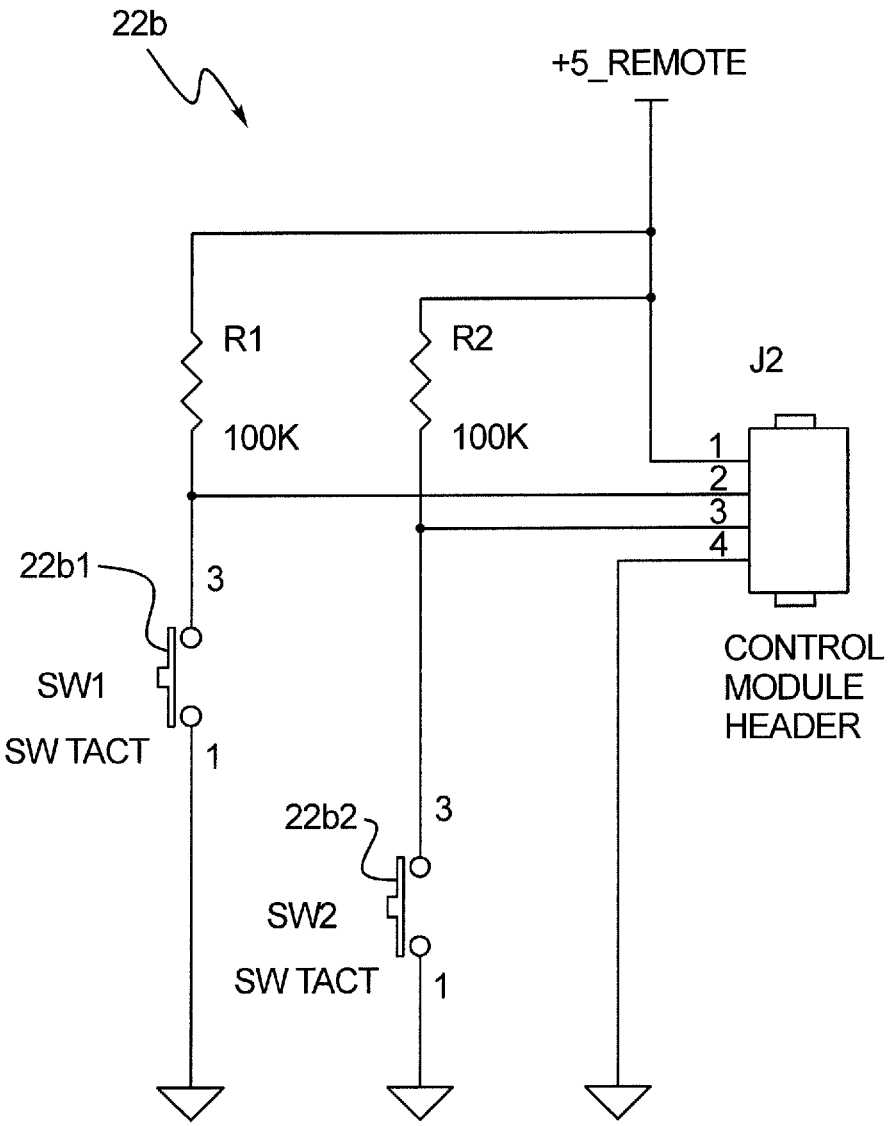
FIG. 6 is a circuit schematic of an exemplary user interface module.

The schematic of FIG. 6 illustrates another exemplary user interface module 22*b* that may be used with a color changing LED device having volatile active emissions, such as the device 10 of FIG. 1. Unlike the user interface modules 22, 22*a* of control units 20, 20*a*, the user interface 22*b* of FIG. 6 provides two tact switches 22*b*1, 22*b*2 wherein each switch 22*b*1, 22*b*2 may be electrically closed or opened based on the position of a key 18. The user interface module 22*b* may alternatively comprise slide switches, toggle switches, push buttons, or combinations thereof. The user interface module 22*b* may also provide fewer or more switches depending on the key 18 type. In the present embodiment, engaging the key 18, for example by pressing or rotating the key 18, may electrically open one or more of the switches 22*b*1, 22*b*2, transmitting a 5 VDC, or a logical high signal, to an input of a connected microprocessor 26. Accordingly, when the key 18 is not engaged by a user, switches 22*b*1, 22*b*2 may be electrically closed to transmit a 0 VDC, or a logical low signal, to an input of a connected microprocessor 26. The resulting action corresponding to the different combinations of input from the tact switches 22*b*1, 22*b*2 may be dependent on a predetermined sequence of operations stored within the microprocessor 26.

Figure 7:
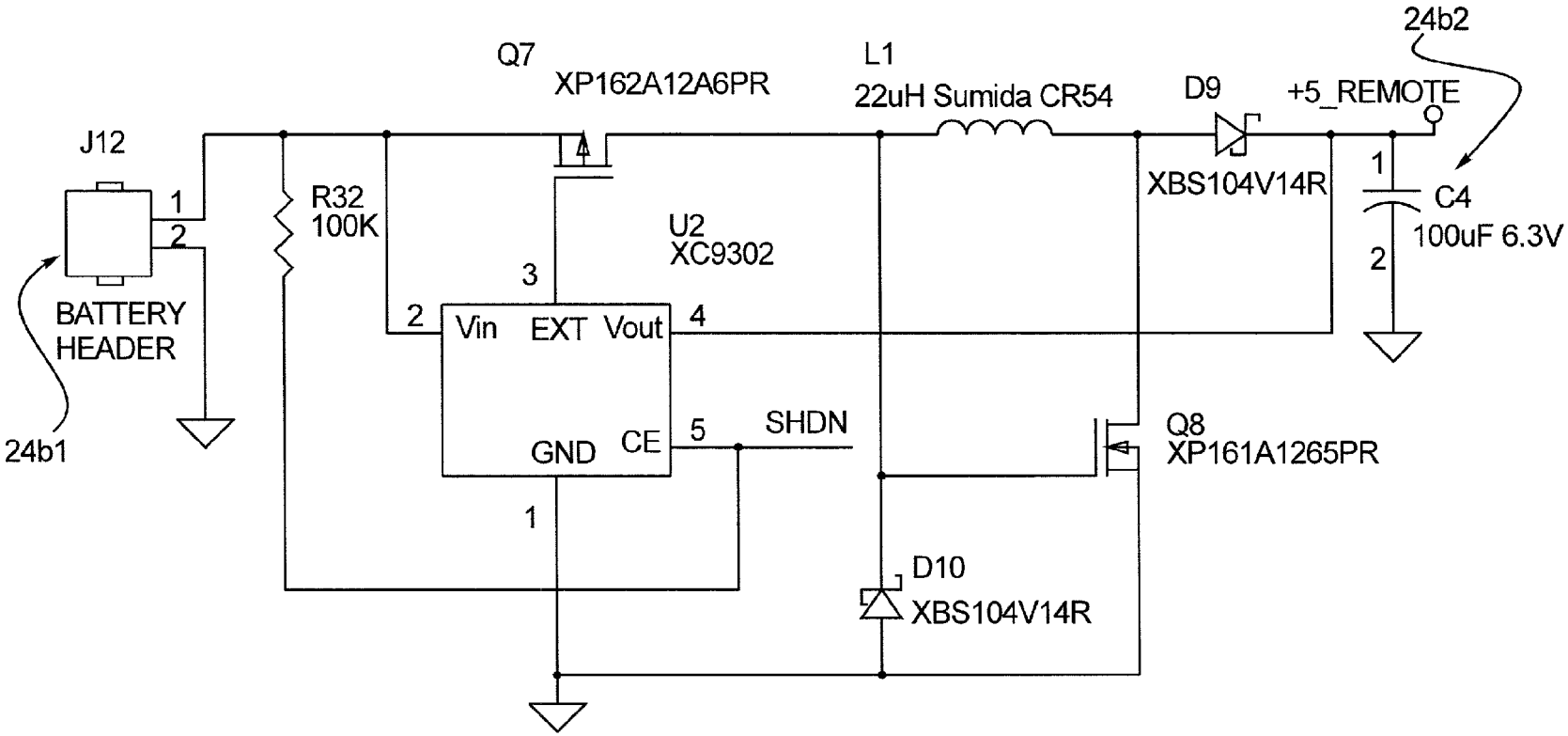
FIG. 7 is a circuit schematic of an exemplary driver circuit.

Turning to FIG. 7, a more detailed view of a driver circuit 24*b* similar to the driver circuit 24 of FIG. 4 is provided. While many other configurations are possible, the driver circuit 24*b* of FIG. 7 serves as a buck-boost converter having an input 24*b*1 and an output 24*b*2. The driver circuit 24*b* may be configured to accept a wide range of DC input voltages, for example between 2 to 10 VDC, at the input 24*b*1 from a power source, for example, one or more batteries, or the like. The buck-boost converter serves to buck or boost the received input voltage to a predetermined DC output voltage, for example 5 VDC, at the output 24*b*2. The output 24*b*2 may provide the DC voltage required to power the rest of the control unit 20, for example the microprocessor 26, the LED array 28, and the volatile active dispensers 30, 31, 32. If needed, the driver circuit 24*b* may also provide additional current for any connected auxiliary modules 33. Based on the application, the driver circuit 24*b* may alternatively take the form of a buck converter, a boost converter, or any other voltage converter.

Referring back to FIG. 4, the driver circuit 24 may provide power to the reference terminals of the microprocessor 26, for example, 5 VDC across pins 1 and 14. One or more tact switches may be coupled to the inputs of the microprocessor 26, for example via pins 2 and 10, to selectively enable the LED array 28 and/or the volatile active dispensers 30, 31, 32 according to user input. Depending on the selected mode of operation, the microprocessor 26 may generate signals at output pins, for example pins 6-8 and 11-13, corresponding to the volatile active dispensers 30, 31, 32 and the LED array 28, respectively. Particularly, pulse width modulated (PWM) signals may be generated at the output pins according to a predetermined sequence of operations stored within the microprocessor 26.

Figure 8:
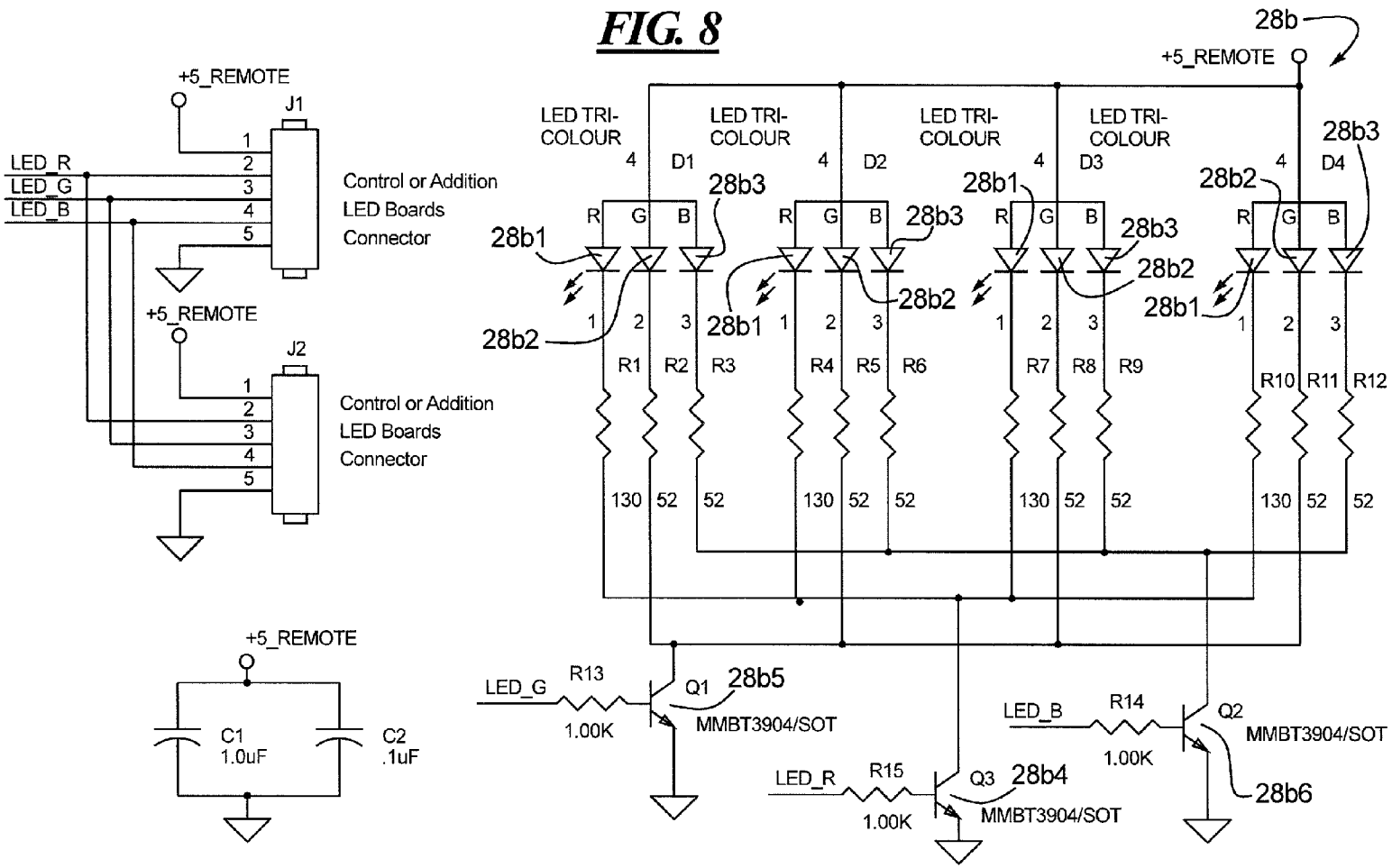
FIG. 8 is a circuit schematic of an exemplary LED array module.

As shown in FIG. 8, another exemplary LED array 28*b* may include a plurality of colored LEDs arranged in clusters of red, green and blue (RGB) LEDs 28*b*1-3. Power to the LED array 28*b* may be provided by a driver circuit 24, which is coupled in parallel to the LED array 28*b*. The microprocessor 26 may control one or more colors of the LED array 28*b* by selectively enabling a plurality of transistors 28*b*4-6. More specifically, the transistors 28*b*4-6 may turn on the LEDs 28*b*1-3 by enabling current to pass through the respective LEDs 28*b*1-3. For example, the first transistor 28*b*4 enables current to the red LEDs 28*b*1, the second transistor 28*b*5 enables current to the green LEDs 28*b*2, and the third transistor 28*b*6 enables current to the blue LEDs 28*b*3. Alternatively, the LED array 28*b* may comprise fewer or additional LEDs, and may also comprise LEDs of colors other than red, green or blue. The LED array 28*b* may also be extended to include a white LED and a corresponding transistor for providing illumination light. Furthermore, to evenly distribute and to optimize lighting effects, the LEDs 28*b*1-3 of the LED array 28*b* may be distributed radially on a satellite LED board, or the like.

As described above, a predetermined sequence of multicolor light shows may be preprogrammed onto the microprocessor 26. In an exemplary sequence, light shows from the LED array 28 may be enabled first by rotating the key 18 to an on position. Subsequently, the microprocessor 26 may begin a first of a plurality of light shows and begin cycling through the different colors. Once the switch 19 associated with the key 18 has been pressed, the microprocessor may toggle to a subsequent light show. Similarly, consecutive presses of the switch 19 may toggle the microprocessor 26 through any remaining light shows. During any point in the sequence, pressing and holding the switch 19 may instruct the microprocessor 26 to pause and hold one color instead of cycling through light patterns. The microprocessor 26 may be programmed to hold a color until the switch 19 is pressed a second time. Rotating the key 18 into an off position may remove all power from the control unit 20. Alternatively, the sequence may further include selective control of a volatile active dispenser 30, 31, 32 to alter volatile active emission rates, control of an optional white LED, or the like.

Figure 9:
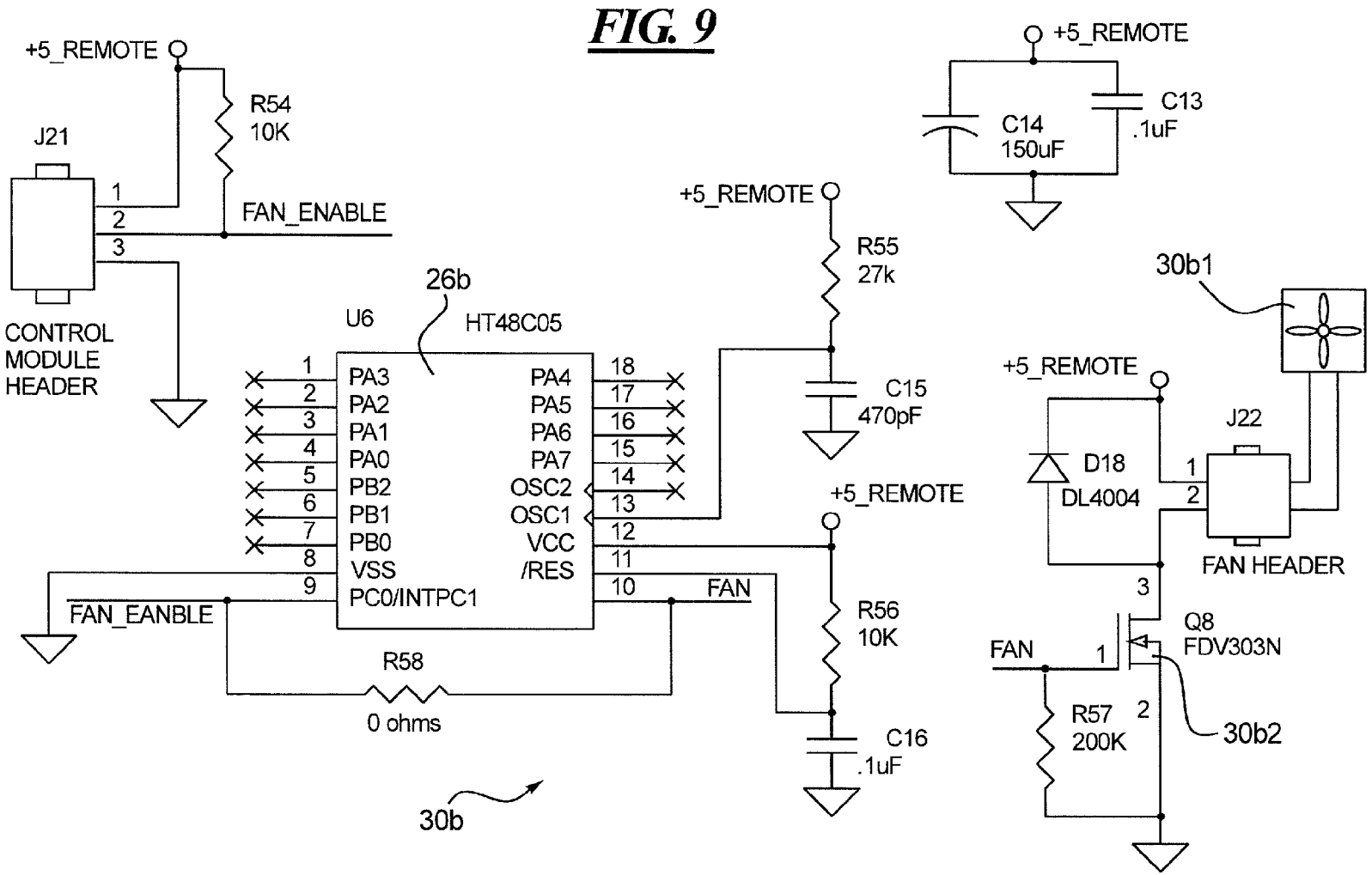
FIG. 9 is a circuit schematic of an exemplary volatile active dispenser module.

Turning to FIG. 9, an exemplary volatile active dispenser module 30*b* for a low output fan 30*b*1 to facilitate volatile active emissions from a passive delivery element is provided. More specifically, a connected microprocessor or microcontroller 26*b* may increase or decrease volatile active emission rates in response to user input. The volatile active dispenser 30*b* may be powered by the driver circuit 24 of FIG. 4 and controlled by an output of the microcontroller 26*b*, for example, pin 10. The microcontroller 26*b* may selectively enable the volatile active dispenser 30*b* by controlling current to the transistor 30*b*2. More specifically, an enabling signal from pin 10 of the microcontroller 26*b* may cause the transistor 30*b*2 to switch on, allow current to flow through the low output fan 30*b*1, and thus, increase the volatile active emission rate. Accordingly, a disabling signal from pin 10 of the microcontroller 26*b* may cause the transistor 30*b*2 to switch off, prevent current flow through the low output fan 30*b*1, and decrease the volatile active emission rate. Similarly, the volatile active dispenser 30*b* may be adapted to incorporate a high output fan, a heater element, a piezo electric atomizer, or combinations thereof. A high output fan may require additional power supplied by an auxiliary power source or an adapter. A heater element may comprise a ceramic encased metal oxide heater powered by the driver circuit 24 or an additional power source. A piezo electric atomizer may comprise a control system which may also be powered by the driver circuit 24.

Figure 10:
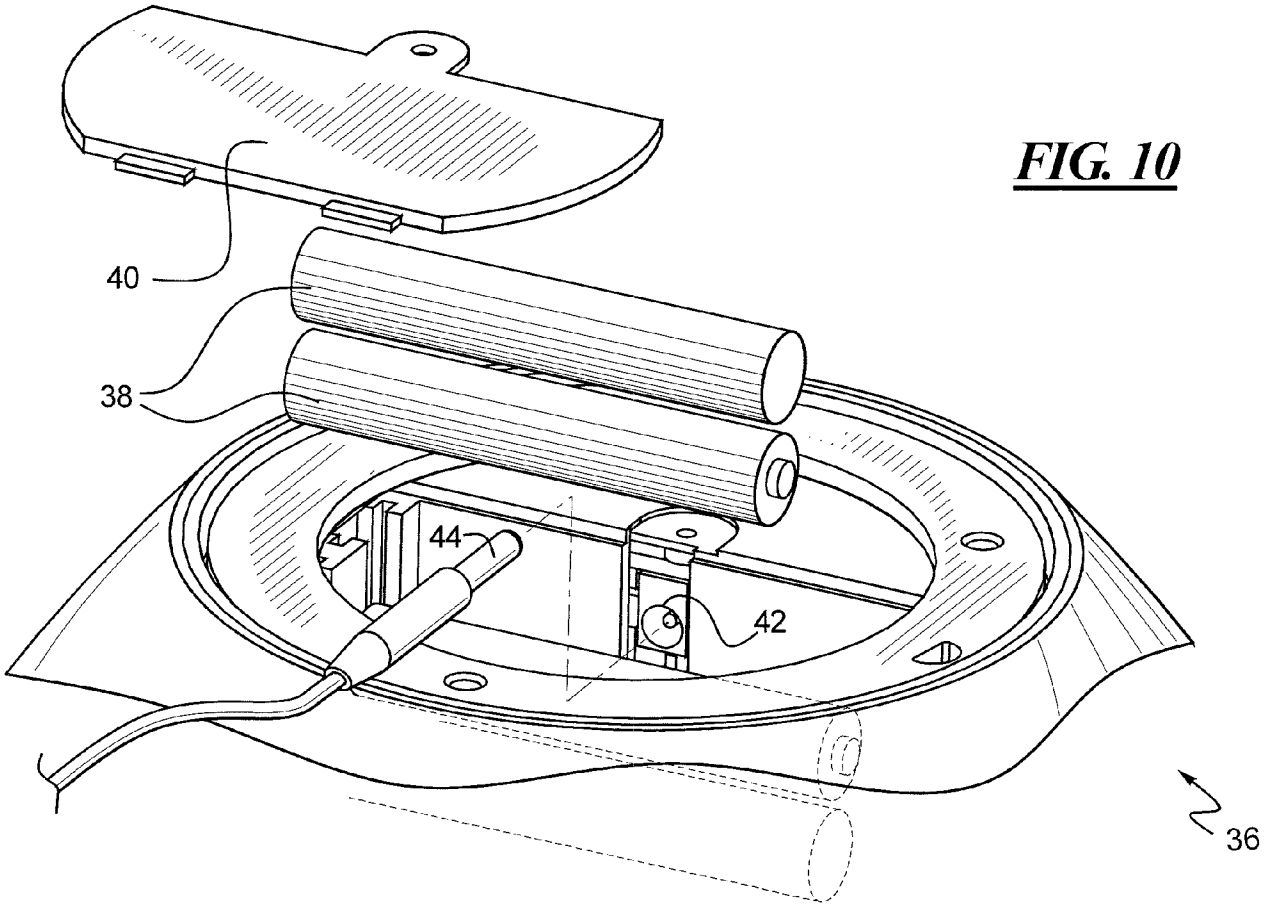
FIG. 10 is a perspective view of an exemplary hidden power jack.
Figure 11:
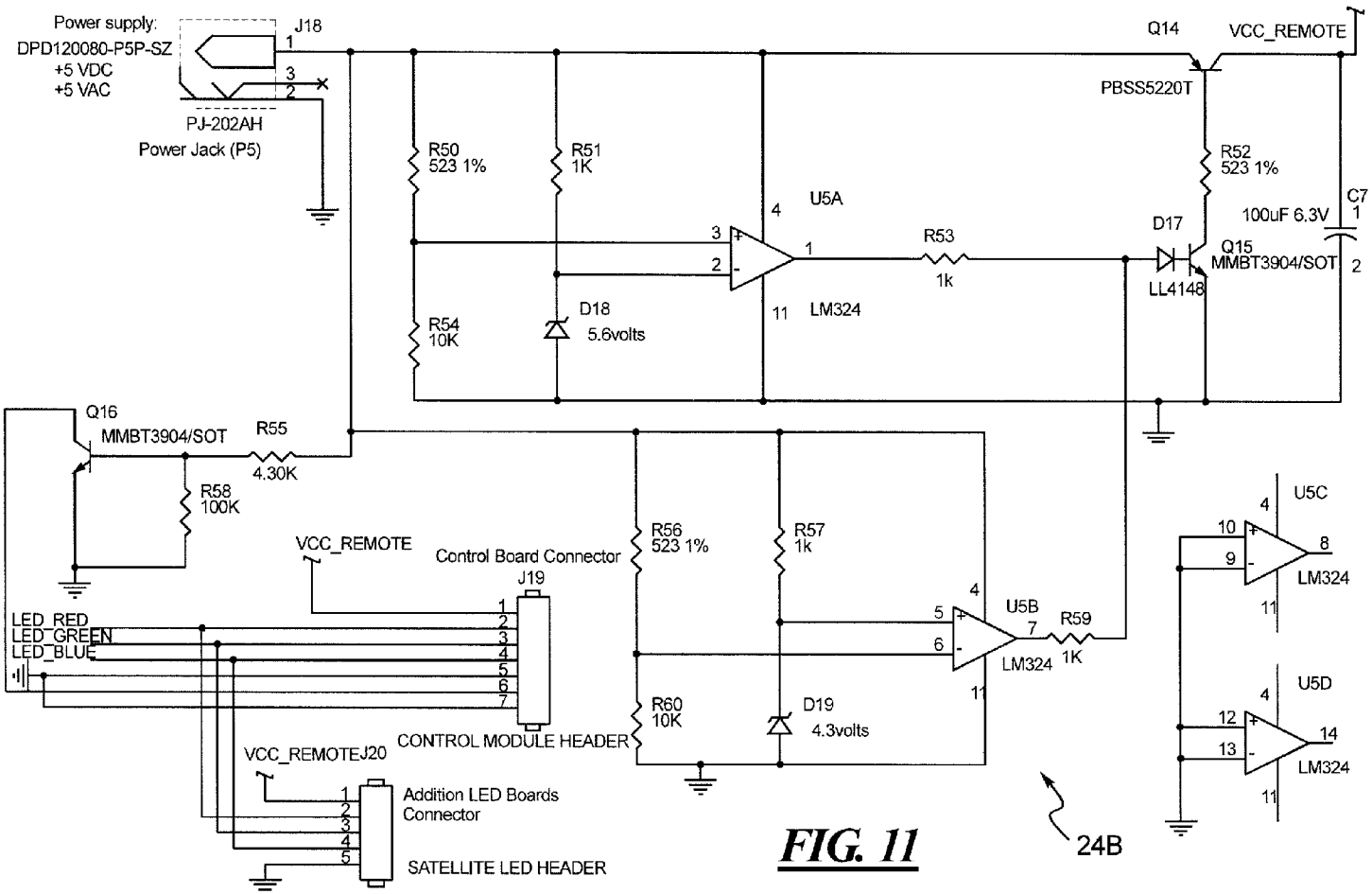
FIG. 11 is a circuit schematic of an exemplary power jack module.

Referring now to FIG. 10, an exemplary battery compartment 36 for housing a DC power source is shown with batteries 38 and a compartment lid 40. The size and number of batteries 38 required may vary depending on the type of the driver circuit 24 employed and the amount of load connected to the driver circuit 24. As in the exemplary embodiment of FIG. 4, the driver circuit 24 may be configured as a buck-boost converter which converts any input voltage between 2 and 10 VDC to a 5 VDC output. Specifically, the compartment 36 may house, for example two to four AA alkaline batteries in series for providing 3 to 6 VDC, respectively. The battery compartment 36 may also include a hidden input jack 42 for receiving an adapter plug 44, which may be associated with, for example the power jack module 34*b* of FIG. 11. The power jack module 34*b* may be used to supply additional power to components that consume more power than the driver circuit 24 is capable of producing. In the exemplary schematic of FIG. 11, the power jack module 34*b* is configured to accept regulated 5 VDC, for example, from a plug-in class 2 power supply. Alternatively, the input jack 42 may be configured to receive more than just one type of plug 44, such that a wider range of adapters, in terms of physical size and voltage ratings, may be used. Aside from convenience, this also enables the device to be sold, and consumers to purchase the device, without the expense of a specially designed power adapter of its own. Moreover, the hidden input jack 42 may be disposed inside the battery compartment 36 to provide a more compact, clean and aesthetically pleasing design.

Based on the foregoing, it can be seen that the present disclosure provides control of color changing LED devices with no external switches, volatile active emissions and a hidden input jack. The modular design of the disclosure enables its application to a wide range of devices with similar features. The disclosed modules further promote the interchangeability and the expandability of modules and features associated with the disclosure.

While only certain embodiments have been set forth, alternatives and modifications will be apparent from the above description to those skilled in the art. These and other alternatives are considered equivalents and within the spirit and scope of this disclosure.

What is claimed is:

1. A modular circuit for lighting devices with active emissions, comprising:

a control unit, the control unit comprising a driver circuit, a microprocessor, a plurality of light emitting diodes (LEDs), and an active dispenser, the operation of the microprocessor for activating a light show and emitting a volatile active substance being controlled by an active cartridge used within the lightning device;

a power jack module;

a battery compartment; and a hidden input jack disposed within the battery compartment.

2. The modular circuit of claim 1, wherein the plurality of LEDs is radially disposed on a satellite LED board.

3. The modular circuit of claim 1, wherein the plurality of LEDs comprises at least one red LED, one green LED and one blue LED.

4. The modular circuit of claim 1, wherein the plurality of LEDs comprises at least one white LED.

5. The modular circuit of claim 1, wherein the active dispenser further comprises a heater element.

6. The modular circuit of claim 1, wherein the active dispenser comprises a low output fan.

7. The modular circuit of claim 1, wherein the active dispenser comprises a high output fan.

8. The modular circuit of claim 1, wherein the active dispenser comprises a piezo electric atomizer.

9. The modular circuit of claim 1, wherein the microprocessor controls an output rate of the active dispenser.

10. The modular circuit of claim 1, wherein at least one light show is stored in the microprocessor.

11. The modular circuit of claim 10, wherein the microprocessor controls an output rate of the active dispenser based on the selected light show.

12. The modular circuit of claim 1, wherein the driver circuit comprises at least one switch providing user input to the microprocessor.

13. A modular circuit for lighting devices with active emissions, comprising:

a power jack module;

a battery compartment;

a hidden input jack disposed within the battery compartment; and a control unit, the control unit comprising a driver circuit, a microprocessor, a plurality of colored LEDs, and an active dispenser, the operation of the microprocessor for activating a light show and emitting a volatile active substance being controlled by an active cartridge used within the lightning device and the active dispenser comprising one or more components selected from the group consisting of:

a low CFM fan;

a high CFM fan;

a heater element; and a piezo electric atomizer.

14. The modular circuit of claim 13, wherein the plurality of colored LEDs is radially disposed on a satellite LED board.

15. The modular circuit of claim 13, wherein the plurality of colored LEDs comprises at least one red LED, one green LED and one blue LED.

16. The modular circuit of claim 13 further comprising at least one white LED.

17. The modular circuit of claim 13, wherein the microprocessor controls an output rate of the active dispenser.

18. The modular circuit of claim 13, wherein at least one colored light show is stored in the microprocessor.

19. The modular circuit of claim 18, wherein the microprocessor controls an output rate of the active dispenser based on the selected colored light show.

20. The modular circuit of claim 13, wherein the driver circuit comprises at least one switch providing user input to the microprocessor.

21. A modular circuit for lighting devices with active emissions, comprising:

a control unit comprising a driver circuit, a microprocessor storing a plurality of colored light shows, a plurality of colored LEDs, and an active dispenser;

a power jack module;

a battery compartment;

a hidden input jack disposed within the battery compartment; and an active cartridge for controlling the operation of the microprocessor for activating a light show and emitting a volatile active substance for performing one or more functions selected from the group consisting of:

activating a colored light show;

turning off the colored light show;

holding a color selected from the colored light show;

adjusting an intensity of the colored LEDs;

adjusting an output rate of the active dispenser; and scrolling through the plurality of colored light shows.

* * * * *